United States Patent [19]

Kagström

[11] Patent Number: 5,034,707

[45] Date of Patent: Jul. 23, 1991

[54] COMBINER ARRANGEMENT IN A RADIO BASE STATION

[75] Inventor: Leif S. Kagström, Ekerö, Sweden

[73] Assignee: Telefonaktiebolaget LM Ericsson, Stockholm, Sweden

[21] Appl. No.: 446,690

[22] Filed: Dec. 6, 1989

[51] Int. Cl.[5] ..... H01P 5/12

[52] U.S. Cl. ..... 333/126; 333/227; 333/230; 455/103

[58] Field of Search ..... 333/126, 135, 227, 230; 455/81, 103, 129

[56] References Cited

U.S. PATENT DOCUMENTS

| | | | |
|---|---|---|---|
| 3,124,768 | 3/1964 | Tilston | 333/126 |
| 3,516,030 | 6/1970 | Brumbelow | 333/230 X |
| 4,881,051 | 11/1989 | Tang et al. | 333/135 X |

*Primary Examiner*—Paul Gensler

*Attorney, Agent, or Firm*—Burns, Doane, Swecker & Mathis

[57] ABSTRACT

A combiner arrangement in a radio base station including a number of waveguide cavity resonators operating as channel filters in known manner. According to the invention, each resonator is divided into two substantially equal cavity resonsator parts. One base station transmitter is connected to one of the resonator parts and another transmitter is connected to the other resonator part. The decoupling of a resonator consists of two clamp-like elements situated in the center of the resonator. The coaxial connection to the antenna consists of coaxial pieces between the resonators and all the resonators are connected in series to the antenna.

2 Claims, 3 Drawing Sheets

COMBINER ARRANGEMENT IN A RADIO BASE STATION

FIELD OF THE INVENTION

The present invention relates to a combiner arrangement in a radio base station which communicates with a number of mobile stations in a mobile telephone system. More particularly, this invention concerns a new arrangement of connecting the resonators used in such a combiner. The resonators can consist of waveguide cavity resonators, coaxial resonators or ceramic resonators.

DESCRIPTION OF PRIOR ART

Generally, combiners are used in a radio base station as so called channel filters between the various transmitters and the base station antenna to prevent the radio frequency signal transmitted from one of the transmitters to influence the other transmitters, and so that the transmitting radio frequency signal or signals will reach the antenna without serious attenuation. The appended FIG. 1 shows a general combiner arrangement consisting of four waveguide resonators R1–R4 which are connected between the respective radio transmitter S1–S4 and the antenna A of a radio base station.

Resonator R1 has a resonant frequency $f_1$ which is the same as the radio transmitting frequency of transmitter S1. Resonator R2 has a resonant frequency $f_2$ which is the same as the radio transmitting frequency of transmitter S2 and so on.

When, for example, transmitter S1 is going to transmit and, simultaneously transmitter S3 transmits, radio signals with the frequencies $f_1$ and $f_3$ reach the antenna. Moreover, the radio signals will be conducted and reflected back to the other transmitters S2 and S4. The resonator filters R2 and R4, however, will attenuate these signals and very weak signals with the frequencies $f_2$ and $f_4$ will reach the respective transmitter. The filter characteristics of the respective resonator is schematically shown in FIG. 2.

The design of the resonator filters in a prior art combiner can be illustrated as in FIG. 3. Each resonator consists of a waveguide with rectangular or quadratic cross-section and are packed together four by four, for example. The input ports $i_1$–$i_4$ of the resonators R1–R4 consists of loops. Each such a loop can have a length equal to a quarter wavelength inside the resonator waveguide. The output ports of the resonators can be concentrated to one single output as shown in FIG. 3 by means of outgoing loops o4–o2, each with a quarter wavelength. In order to connect the two packets of resonators to the antenna A, coaxial cables KX1 and KX2 are used to the antenna connection point A0. The length of each cable KX1, KX2 then should be an integral number of quarter wavelengths.

By this arrangement the influence of reflected waves from the resonator packets and the antenna A in the common connection point A0 can be kept on a small value.

Combiner arrangements, for example, such as shown in FIG. 3 have, however, certain shortcomings. The width of the resonator elements R1–R4 and R5–R8 implies that the cable length to the common connection point A0 is rather long (in the order of about 1 meter each). If the base station is to be expanded with further transmitters and associated combiners, an increasing number of combiner resonators give rise to connection problems between the various combiners and the antenna. A further increase in the connection cable length will seriously affect the matching of the resonator outgoing ports to the antenna input. The antenna has a characteristic impedance $Z_o$ which should be as far as possible matched to the various resonators but if several cables are connected and the cable lengths are increased, the variations in the impedance as seen from the antenna in the common connection point A0 can be a serious problem. The diagram according to FIG. 4 illustrates the variation of the reflection factor r between the connection point A0 and the antenna input, i.e. the variation of the output impedance of the resonator arrangement in FIG. 3 within a certain frequency band 935–960 MHz and in dependence on the number of quarter wavelength elements (number of channels) used. In the ideal case, the characteristics should be as flat as possible within the frequency band, i.e. the variation of the reflection factor r should be as small as possible so that acceptable values are obtained even in the band limits (935 MHz and 960 MHz).

Curve a illustrates the variation of the reflection factor r when more than 8 resonators (frequency channels) are connected to the antenna. Curve b illustrates the reflection factor variation for 8 channels and curve c illustrates the reflection factor variation when only 4 channels are connected. The present combiner arrangement with 32 channels connected can give a reflection factor characteristic according to curve c, i.e. as good properties as the prior art arrangement with only 4 channels.

SUMMARY OF THE INVENTION

An object of the present invention is to create a combiner arrangement in which the included waveguide resonators are connected in such a manner that a better matching to the antenna impedance can be obtained within the whole frequency band used.

Another object of the invention is to facilitate the connection of further combiner resonators upon expansion of the combiner arrangement.

Briefly, the present invention meets the above objects by dividing each waveguide resonator into two parts thus creating a double resonator filter and connecting a transmitter to each of the parts, and connecting the assembly of such double resonators in a serial manner separated by coaxial pieces with a length equal to quarter wavelength.

DESCRIPTION OF PREFERRED EMBODIMENTS

FIGS. 1-4 have been described above under "BACKGROUND OF THE INVENTION".

Figure 5:
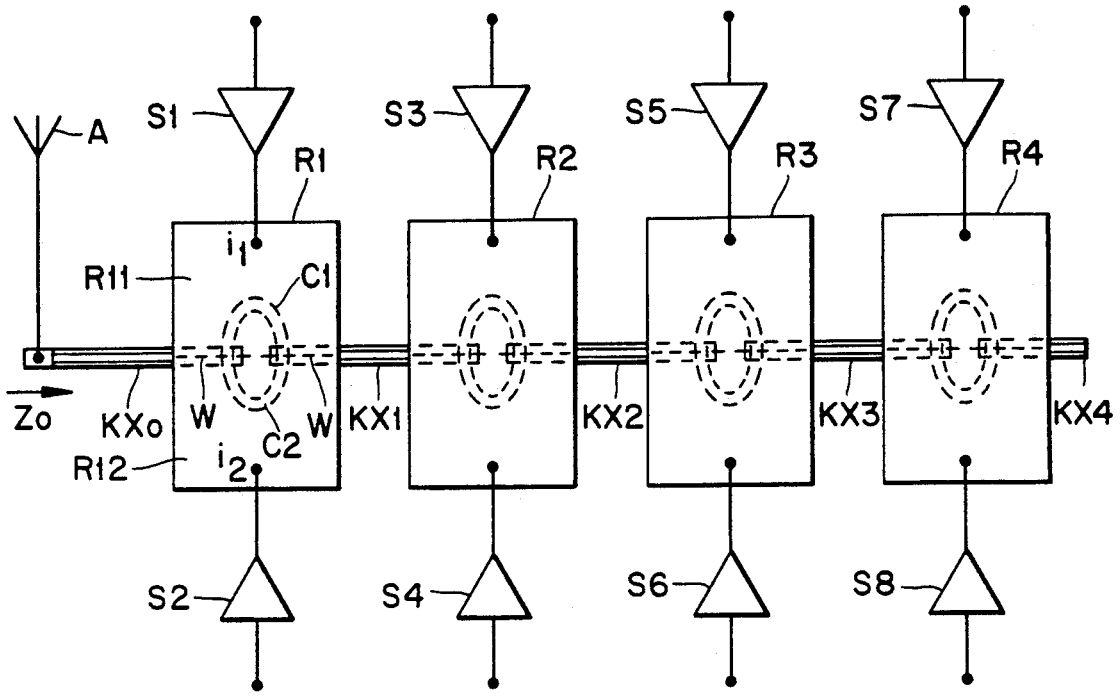
FIG. 5 shows a block diagram of a combiner arrangement according to the present invention.

FIG. 5 shows a schematic diagram of a combiner arrangement according to the present invention, including four waveguide resonators R1-R4. Each resonator R1-R4 consists of a rectangular "box" as illustrated in FIG. 5 (as seen from above) and which will be further described in connection with FIGS. 6 and 7. Each resonator has the same external and internal structure. Also the geometrical dimensions of each resonator are substantially the same, since the whole resonator assembly in the combiner is broadband dimensioned, i.e. dimensioned for a frequency band within certain limits, for example, 935-960 MHz. The necessary tuning of each individual cavity resonator due to the differing transmitter frequencies $f_1 \ldots f_n$ is made by tuning screws, stubs etc. in known manner and does not form any part of the inventive idea. The channel separation, i.e. the difference between frequencies $f_1$, $f_2 \ldots$ is for example 475 kHz.

The space of each resonator, as for example resonator R1 (FIG. 5) is divided into two parts by means of a wall W, in order to create a cavity resonator for the transmitter signals from transmitter S1 (frequency $f_1$) and a cavity resonator for the transmitter signals from transmitter S2 (frequency $f_2$). The two cavity resonators within resonator R1 can be broadband dimensioned as mentioned above.

In the center of resonator R1, the wall W is provided with an opening in order to give space for an outcoupling element which consists of two connectors C1 and C2 connected together at their ends. Connector C1 then extends into the space of the resonator cavity R11 and connected C2 extends into the space of resonator cavity R12. Each connector forms an outcoupling loop with an electrical length equal to a quarter wavelength. Inlets $i_1$ and $i_2$ to the respective resonator cavities R11 and R12 from the transmitters S1 and S2, respectively consist each of an inductive loop which extends into the respective cavity in known manner.

The above described structure for resonator R1 is the same for the remaining resonators R2-R4. Coaxial pieces KX0, KX1, KX2 and KX3 connect the outcoupling elements of each resonator together and to the antenna in a serial manner.

Figure 1:
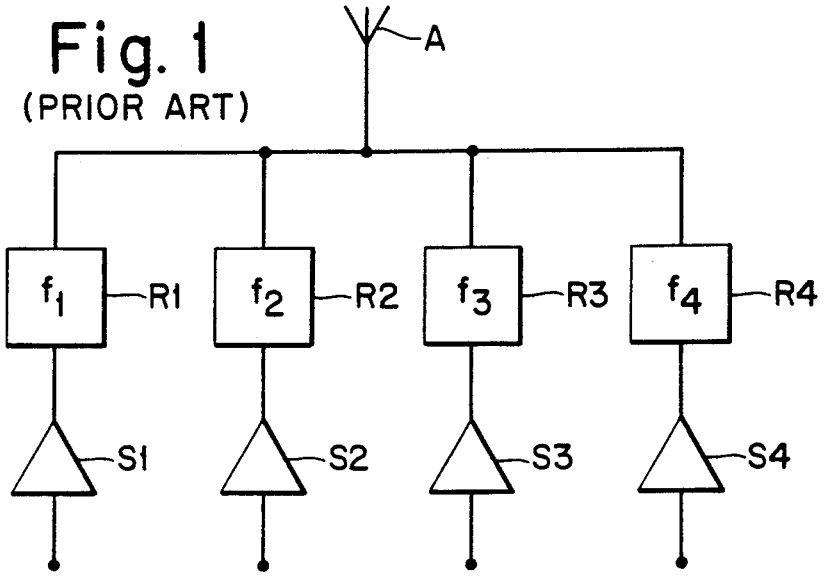
Fig. 1 (PRIOR ART)
FIG. 1 shows a principal block diagram of a combiner arrangement known in the art.
Figure 2:
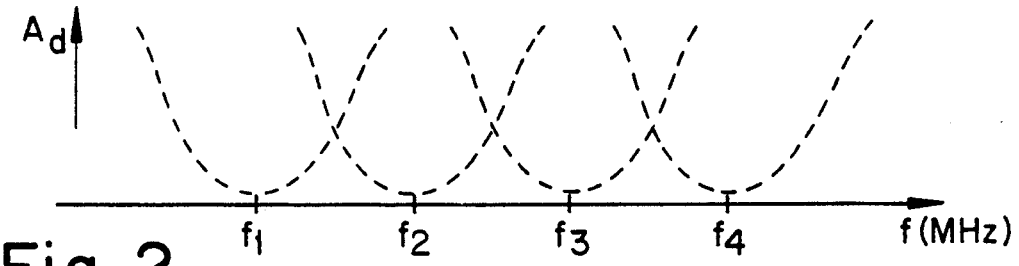
Fig. 2 (PRIOR ART)
FIG. 2 shows the filter characteristics of the individual resonators shown in FIG. 1.
Figure 3:
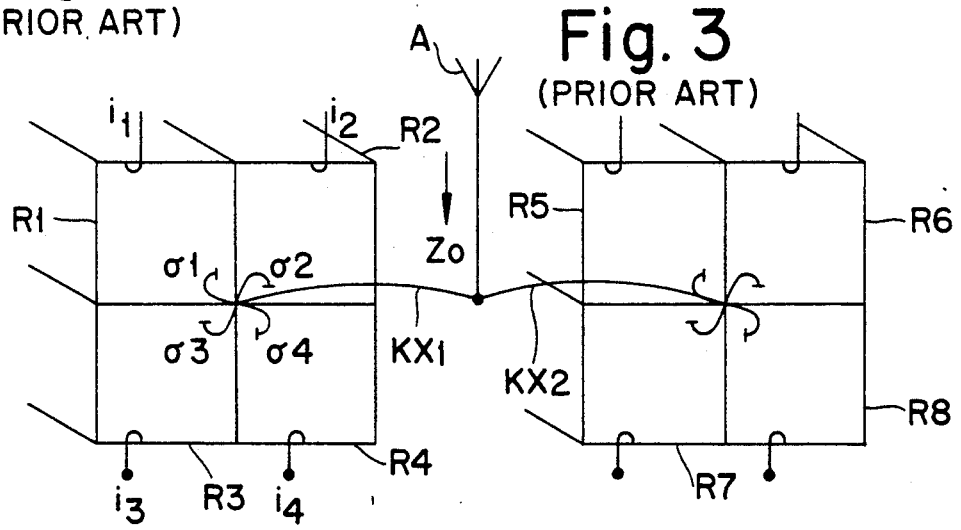
Fig. 3 (PRIOR ART)
FIG. 3 illustrates schematically a prior art combiner arrangement including eight resonators.
Figure 4:
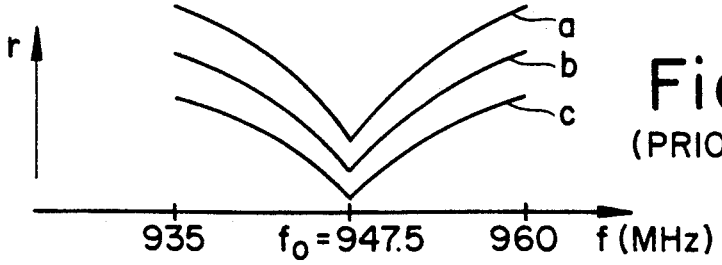
Fig. 4 (PRIOR ART)
FIG. 4 shows a reflection factor diagram.
Figure 6:
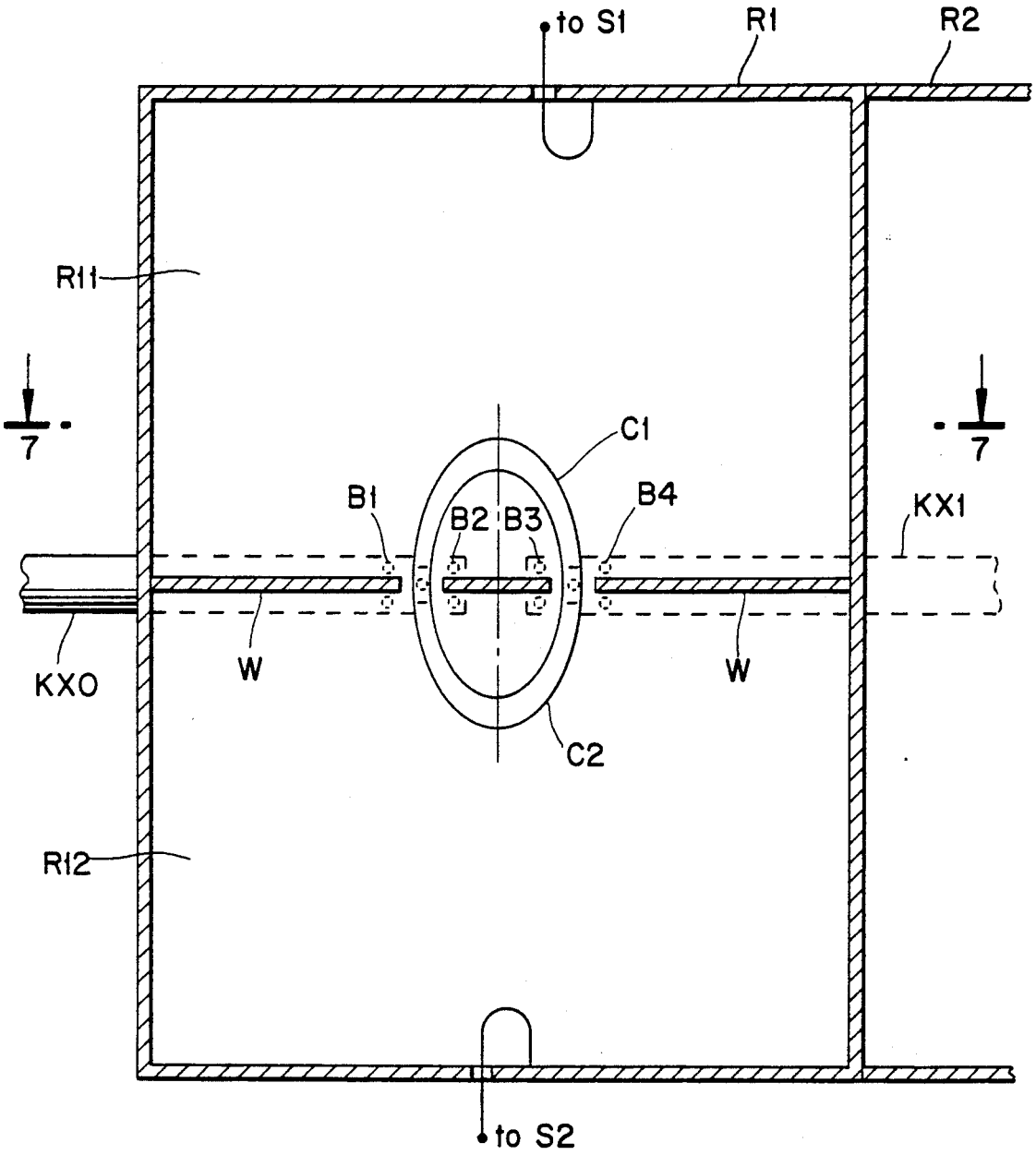
FIG. 6 shows a cross-sectional view from one side of a resonator in the arrangement according to FIG. 5 and including a decoupling element.

With reference to FIG. 6, the outcoupling element and the coaxial connections are shown more in detail. The two connectors C1 and C2 are fastened at their ends to the lower resonator wall and are bent near to the fastening place so as to be directed at an angle upwards from the lower resonator wall, in order to get a desired coupling degree. When the connectors C1 and C2 are correctly directed they together show a line impedance $Z_0 = 50\Omega$.

Figure 7:
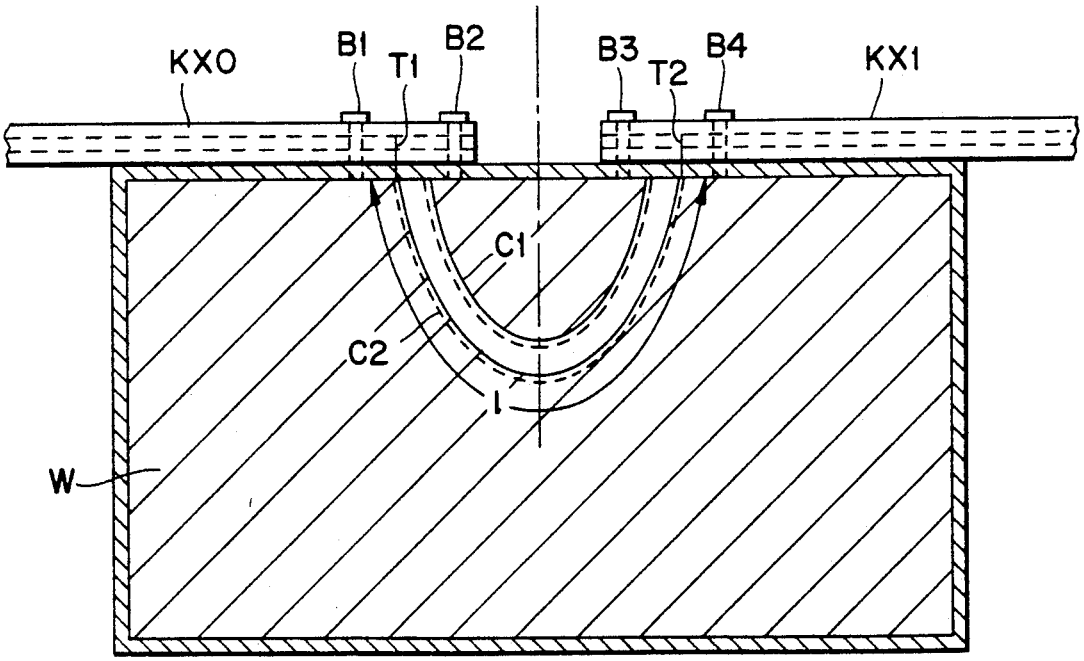
FIG. 7 shows a cross-sectional view from above of the resonator shown in FIG. 6.

As shown in FIG. 7, a tab T1 and T2 at the respective fastening place of connectors C1 and C2 connects these to the center conductor of the coaxial piece KX0 and KX1, respectively. The two connectors C1 and C2 should be isolated from the wall W and from the lower resonator wall, so that the emf induced in the loop formed by the two clamps is coupled to the center conductor of the coaxial line formed by the pieces KX0, KX1 and not to the resonator walls.

As can best be seen from FIG. 7, the coaxial piece KX0 to the antenna A is fastened to the lower resonator wall by means of four screws of which two, B1 and B2, are shown in FIG. 7. The center conductor of the coaxial piece KX0 will then be galvanically connected to one shank of the connectors C1, C2. Coaxial piece KX1 to resonator R2 is likewise fastened by means of four screws of which two, B3 and B4, are shown connecting the center conductor of coaxial piece KX1 to the other shank of connectors C1, C2. The length 1 of each connector is $\lambda_o/4$ where $\lambda_o$ corresponds to the center frequency $f_o$ of the used band. (i.e. 935-960 MHz).

The two connectors C1 and C2 form an outcoupling element for the electromagnetic field in the two cavity resonators R11 and R12, respectively. Each connector is dimensioned to have a nominal impedance of $2Z_o(=100\Omega)$. Since the connectors electrically are connected in parallel they form together an impedance $=Z_o(=50\Omega)$ to the coaxial arrangement formed by the two pieces KX0, KX1. Thus a match is obtained to the antenna from each of the resonators R1-R4. It is furthermore easy to expand the number of resonators by connecting further coaxial connection pieces to the right terminal of resonator R4. This expansion only requires a coaxial piece having an electrical length equal to a quarter wavelength. This in turn implies that a greater number of resonators in the combiner can be connected to one and the same antenna.

I claim:

1. A combiner arrangement in a radio base station between a plurality of radio transmitters and a base station antenna, each of said plurality of transmitters transmitting on a different one of a plurality of radio frequencies, said combiner arrangement comprising:

a plurality of waveguide resonator elements, each of said plurality of waveguide resonator elements including a partitioning means for dividing each of said waveguide resonator elements into first and second cavity resonators of substantially equal size, each of which conducts a different one of said plurality of radio frequencies and attenuates the remaining ones of said plurality of radio frequencies, a first input port connecting said first cavity resonator to a first one of said plurality of transmitters, a second input port connecting said second cavity resonator to a second one of said plurality of transmitters, a first coupling means arranged in a center of said first cavity resonator for coupling a signal out of said first cavity resonator;

a second coupling means arranged in a center of said second cavity resonator for coupling a signal out of said second cavity resonator;

a first output port connected to respective first ends of said first and second coupling means, and a second output port connected to respective second ends of said first and second coupling means, said plurality of waveguide elements being connected serially to an antenna by a coaxial conductor means including a plurality of coaxial conductor elements each connecting a respective first output port of one of said waveguide resonator elements with a respective second output port of another of said plurality of waveguide resonator elements.

2. A combiner arrangement as claimed in claim 1, wherein each of said first and second coupling means comprises:

a coupling loop having two oppositely arranged connectors connected together and to said output port of said waveguide resonator element, said connectors projecting from the wall of the resonator element, and each waveguide resonator element having a length equal to a quarter wavelength of the electrical field in the resonator element.

* * * * *